US008087159B2

(12) United States Patent
Tokura

(10) Patent No.: US 8,087,159 B2
(45) Date of Patent: Jan. 3, 2012

(54) TUBE EXPANDER FOR HEAT EXCHANGER

(75) Inventor: Kenji Tokura, Osaka (JP)

(73) Assignee: Kyoshin Kogyo Co., Ltd., Osaka (JP)

( * ) Notice: Subject to any disclaimer, the term of this patent is extended or adjusted under 35 U.S.C. 154(b) by 1041 days.

(21) Appl. No.: 12/005,214

(22) Filed: Dec. 26, 2007

(65) Prior Publication Data

US 2008/0172863 A1 Jul. 24, 2008

Related U.S. Application Data

(63) Continuation-in-part of application No. 10/515,617, filed as application No. PCT/JP03/06557 on May 26, 2003, now abandoned.

(30) Foreign Application Priority Data

May 22, 2002 (JP) ..... 2002-185332

(51) Int. Cl.
*B23P 15/26* (2006.01)

(52) U.S. Cl. ..... 29/727

(58) Field of Classification Search ..... 29/727, 29/726, 726.5, 503, 890.043, 33 G, 33 T
See application file for complete search history.

(56) References Cited

U.S. PATENT DOCUMENTS

| | | | | |
|---|---|---|---|---|
| 4,835,828 | A | 6/1989 | York et al. | |
| 5,040,405 | A * | 8/1991 | Honma et al. | 72/462 |
| 5,220,722 | A | 6/1993 | Milliman | |
| 5,432,994 | A | 7/1995 | Tokura | |
| 6,176,006 | B1 * | 1/2001 | Milliman et al. | 29/727 |
| 7,448,127 | B2 * | 11/2008 | Tokura | 29/726 |

* cited by examiner

*Primary Examiner* — John C Hong
(74) *Attorney, Agent, or Firm* — Muramatsu & Associates

(57) ABSTRACT

A tube expander is configured so that only the slide body that is worn down can be removed from the slide unit means and a new slide body is attached through the fastening means easily at low cost. The tube expander is configured by a support column formed on a base; a stripper plate which presses down an end plate of the heat exchanger for defining a projection length of heat exchanger tubes, the stripper plate being reciprocally movable along a longitudinal direction of the support column; and a reference stand is connected to the stripper plate and reciprocally movable along the support column for stopping the stripper plate at a predetermined position. A part of the reference stand is slidably attached to a guide bar formed on the support column through a slide unit; and a slide body formed separately from a reference stand is attached to the slide unit located at the support column through a fastening means.

8 Claims, 10 Drawing Sheets

TUBE EXPANDER FOR HEAT EXCHANGER

This is a continuation-in-part of U.S. application Ser. No. 10/515,617 filed Jun. 20, 2005 now abandoned which is a national phase of International Application No. PCT/JP03/06557 filed May 26, 2003 which claims the benefit of Japanese Application No. 2002-185332 filed May 22, 2002, all of which are incorporated herein by reference.

FIELD OF THE INVENTION

The present invention relates to a tube expander for expanding tubes for producing a heat exchanger, and more particularly, to a tube expander for expanding a plurality of tubes inserted in multi-layers of heat dissipation fins to integrally attach the tubes to the heat dissipation fins by pressing mandrels into the tubes.

BACKGROUND OF THE INVENTION

A tube expander of this kind for expanding tubes used for a heat exchanger is known from, for example, Japanese Utility Model Publication No. 1-23650.

The tube expander for expanding tubes used for a heat exchanger disclosed by this publication is configured, as shown in FIG. 4, by a pair of support columns 19*a* that are formed on a base 19 with a predetermined distance, and the support columns 19*a* are connected with one another through a beam 20 at their tops, thereby creating an expander main frame 14*a*.

The expander main frame 14*a* for heat exchanger tubes presses tube expander mandrels 5 into openings of heat exchanger tubes 16 of a heat exchanger 15 that is set on the base 19, thereby integrally forming an end plate 15*a* and a plurality of heat dissipation fins with the heat exchanger tubes 16. For doing this, the tube expander includes a reciprocal movement body 7 having the above noted expander mandrels 5 thereon which is inserted in guide bars (guide post) 21 formed in front of the support column 19*a* in a manner that is up/down movable (reciprocally movable) through two cylinders 6.

Further, on the reciprocal movement body 7, there is provided with a pinion gear 12 that is fitted with a rack 11 vertically formed and an encoder 13 for counting a rotation angle of the pinion gear. The pinion gear 12 and the encoder 13 measure a descending distance of the reciprocal movement body 7 that moves toward the heat exchanger 15.

Further, under the reciprocal movement body 7, a stripper plate 9 having strippers 9*a* is provided which contacts the end plate 15*a* of the heat exchanger 15 and presses down the end plate 15*a* for defining a projection length of the heat exchanger tubes 16 which are projected from the end plate 15*a*.

On the stripper plate 9, a limit switch 10 is provided for detecting a start point of the downward movement of the stripper plate 9 that descends toward the heat exchanger 15 along with the reciprocal movement body 7.

Further, at both sides of the stripper plate 9, balance cylinders 8 are provided. The above noted encoder 13 measures the descending distance of the reciprocal movement body 7 in response to a detection signal from the limit switch 10 as a start signal. When the descending distance reaches a predefined value, the balance cylinders 8 operate to stop the downward movement of the stripper plate 9.

Therefore, in the tube expander for heat exchanger tubes configured in the manner described above, when the value that is measured through the encoder 13 in response to the detection signal from the limit switch 10 as the start signal reaches the predefined value, the balance cylinders 8 operate to stop the downward movement of the stripper plate 9, thereby properly controlling the length of the heat exchanger tubes 16 projected from the end plate 15*a* of the heat exchanger 15.

However, the tube expander for heat exchanger tubes configured in the manner described above has a problem in that a production cost will increase because various equipment such as the limit switch 10, the rack 11, the pinion gear fitted with the rack 11, and the encoder 13 have to be individually attached to the tube expander.

Accordingly, for suppressing the increase of the production cost, a tube expander for heat exchanger tubes as shown in FIG. 3 has been developed which is expected to replace the above described tube expander in the market.

In this tube expander for heat exchanger tubes, a cylinder 4 equipped with a pulse encoder 18 is utilized and a reference stand 1 is attached to an expansion and contraction rod 4*a* of the cylinder 4 through a fixing member 1*a* such as a male screw for stopping the downward movement of the stripper plate 9 where the reference stand 1 is coupled to the stripper plate 9 through a slide body 9*b*.

Therefore, according to the latter tube expander for heat exchanger tubes, it is unnecessary to measure the actual downward distance of the reciprocal movement body 7 and to operate the balance cylinders 8 as required in the former tube expander for heat exchanger tubes, since the projection length of the expansion and contraction rod 4*a* can be set easily through the pulse encoder 18.

Accordingly, the production cost will be decreased because it can eliminate various equipment such as the limit switch 10, the rack 11, the pinion gear fitted with the rack 11, and the encoder 13.

However, the tube expanders for heat exchanger tubes in the conventional technology described above involve the following problems:

In either the former or latter structure described above, the stripper plate 9 is stopped at the predetermined position through only the pair of cylinders that support the both ends of the stripper plate 9.

Thus, when stopping the stripper plate 9 that moves downwardly along with the reciprocal movement body 7 for the tube expansion operation, only the expansion and contraction rod always receives the weight of the stripper plate 9 directly through the reference stand 1 attached to the expansion and contraction rod.

Accordingly, in the situation where only the expansion and contraction rod receives the weight of the stripper plate 9, when the expansion and contraction rod expands greater than a certain degree, the expansion and contraction rod will be instantaneously deformed. A degree of such deformation will increase in proportion to the expansion length of the expansion and contraction rod.

Therefore, in the case where the tube expansion operation is conducted for a heat exchanger 15 whose total length is especially large on the base 19 of the expander main frame 14*a*, the expansion and contraction rod, when in its maximum extended state, may be extended further than the cylinders. As a result, at the moment when the expansion and contraction rod at its maximum extended state receives the weight of the stripper plate 9, there arises a possibility that the expansion and contraction rod is greatly deformed which damages the sealing of the cylinders.

Further, in the case where reciprocal movement means is formed by a rod shaped male screw (not shown) established on the base 19 instead of the cylinders noted above for updown movement of the reference stand 1, there arises a possibility that the rod shaped male screw is greatly deformed similar to the above example and damages threads of the screw.

To solve these problems, the applicant has invented the technology which is disclosed by Japanese Patent Application No. 2000-141590.

In this technology, a part of the reference stand is slidably attached to the above-mentioned support columns through a slide unit. This structure makes it possible that the deformation of the expansion and contraction rod or the rod shaped male screw is decreased when the reciprocal movement means of the reference stand, i.e., the expansion and contraction rod or the rod shaped male screw, receives the weight of the stripper plate instantaneously. Thus, it is expected that the damages to the sealing of the cylinders or the brakeage of the threads of the rod shaped male screw can be effectively avoided.

However, in this arrangement where the part of the reference stand is slidably attached to the above-mentioned support columns through the slide unit, a part of the slide unit will be worn down. This is especially true when the tube expander for heat exchanger tubes is established in a poor environment where dusts and dirts are in the air or when the tube expander for heat exchanger tubes is extremely frequently used, friction arises at the slide unit every time when the tube expansion operation is performed. As a result, it becomes impossible to smoothly move the reference stand and has to replace the reference stand. This not only increases the cost but also requires complicated works for removing the reference stand from the cylinder or the rod shaped male screw and attaching the new reference stand.

The present invention has been made in view of the above problems. It is an object of the present invention to provide a tube expander in which a part of the reference stand is slidably attached to the support column through a slide unit. In this tube expander, only a sliding part of the slide unit of the reference stand can be replaced easily at low cost with a new one without changing the reference stand even when the tube expander is established in the poor environment where dusts and dirts are in the air or when the tube expander for heat exchanger tubes is extremely frequently used.

SUMMARY OF THE INVENTION

To solve the above noted problems, in one aspect of the present invention, a tube expander for heat exchanger tubes is comprised of a support column 19*a* formed on a base 19, a stripper plate 9 having strippers 9*a* which contacts an end plate 15*a* of the heat exchanger 15 and presses down the end plate 15*a* for defining a projection length of heat exchanger tubes 16 which are projected from the end plate 15*a*, the stripper plate 9 being reciprocally movable along a longitudinal direction of the support column 19*a*, and a reference stand 1 connected to the stripper plate 9 and reciprocally movable along the support column 19*a* for stopping the stripper plate 9 at a predetermined position, wherein a part of the reference stand is slidably attached to a guide bar 3 formed on the support column 19*a* through a slide unit 1*a*, and wherein a slide body 1*d* formed separately from the reference stand 1 is attached to the slide unit 1*a* located at the support column 19*a* through a fastening means.

In another aspect of the present invention, a tube expander for heat exchanger tubes is comprised of a support column 19*a* formed on a base 19, a stripper plate 9 having strippers 9*a* which contacts an end plate 15*a* of the heat exchanger 15 and presses down the end plate 15*a* for defining a projection length of heat exchanger tubes 16 which are projected from the end plate 15*a*, the stripper plate 9 being reciprocally movable along a longitudinal direction of the support column 19*a*, and a reference stand 1 connected to the stripper plate 9 and reciprocally movable along the support column 19*a* for stopping the stripper plate 9 at a predetermined position, wherein a part of the reference stand is slidably attached to a guide bar (slide bar) 21 formed opposite to the support column 19*a* through a slide unit 1*c*, and wherein a slide body 1*e* formed separately from the reference stand 1 is attached to the slide unit 1*c* located at the slide bar 21 opposite to the support column through a fastening means.

In another aspect of the present invention, a tube expander for heat exchanger tubes is comprised of a support column 19*a* formed on a base 19, a stripper plate 9 having strippers 9*a* which contacts an end plate 15*a* of the heat exchanger 15 and presses down the end plate 15*a* for defining a projection length of heat exchanger tubes 16 which are projected from the end plate 15*a*, the stripper plate 9 being reciprocally movable along a longitudinal direction of the support column 19*a*, and a reference stand 1 connected to the stripper plate 9 and reciprocally movable along the support column 19*a* for stopping the stripper plate 9 at a predetermined position, wherein a part of the reference stand is slidably attached to a guide bar (slide bar) 21 formed opposite to the support column 19*a* through a slide unit 1*c*, and wherein a slide body 1*e* formed separately from a reference stand 1 is attached to the slide unit 1*c* located at the slide bar 21 opposite to the support column through a fastening means.

Further, at least one of the above noted slide body 1*d* on the slide unit 1*a* located at the support column 19*a* or the above noted slide body 1*e* of the slide unit 1*c* located at the slide bar 21 opposite to the support column 19*a* has a detachable configuration through a fastening means. The slide body 1*d* has a unique structure which enables to be easily removed from the guide bar 3 once it is disconnected from the slide unit 1*a* by loosening the fastening means and slidably shifted either in an upper or lower direction along the guide bar 3. Similarly, the slide body 1*e* has a unique structure which enables to be easily removed from the slide bar 21 once it is disconnected from the slide unit 1*c* by loosening the fastening means and slidably shifted either in an upper or lower direction along the slide bar 21.

Therefore, when the reference stand 1 momentarily receives the weight of the stripper plate 9, since the part of the reference stand 1 is slidably attached to the guide bar 3 formed on the support column 19*a* through the slide unit 1*a* or the part of the reference stand 1 is slidably attached to the guide bar 21 formed opposite to the support column 19*a* through the slide unit 1*c*, the deformation of the expansion and contraction rod or the rod shaped male screw can be reduced through either the slide unit 1*a* or 1*c*.

Further, in the case where the tube expander of the present invention in which the part of the reference stand is slidably formed on the guide bar is established in the poor environment where dusts and dirts are in the air or when the tube expander for heat exchanger tubes is extremely frequently used, only the slide body 1*d* that is worn down can be removed from the reference stand 1 through the fastening means and a new slide body 1*d* is attached through the fastening means easily at low cost, thus, there is no need to replace the reference stand itself.

Further, when both of the slide units 1*a* and 1*c* are used, even when the reference stand 1 momentarily receives the weight of the stripper plate 9, since the reference stand is supported by a plurality of points, the deformation of the expansion and contraction rod or the rod shaped male screw can be further reduced by distributing the weight with appropriate balance.

Further in the tube expander of the present invention, a female screw 1*b* is provided on the reference stand 1 for receiving a guide rod 2 having a male screw thereon, and the reference stand 1 is reciprocally moved along the support column 19*a* by the rotation of the guide rod 2.

Therefore, even when the total lengths of the heat exchangers 15 for tube expansion are different, it is unnecessary to prepare a cylinder having an extension and contraction rod of a stroke that matches the total length of the heat exchanger 15 and to replace the cylinder, because the reference stand 1 can be widely moved by the rotation of the guide rod 2 to an appropriate position that matches the total length of the heat exchanger 15.

BRIEF DESCRIPTION OF THE DRAWINGS

FIG. 1A is a partial perspective view in the vicinity of the reference stand, and FIG. 1B is a diagram for explaining the essential part thereof.

DESCRIPTION OF THE PREFERRED EMBODIMENTS

In order to disclose the present invention in more detail, descriptions will be made with reference to the attached drawings, although explanations for the parts identical to the tube expander in the conventional technology will be omitted.

Figure 1B:
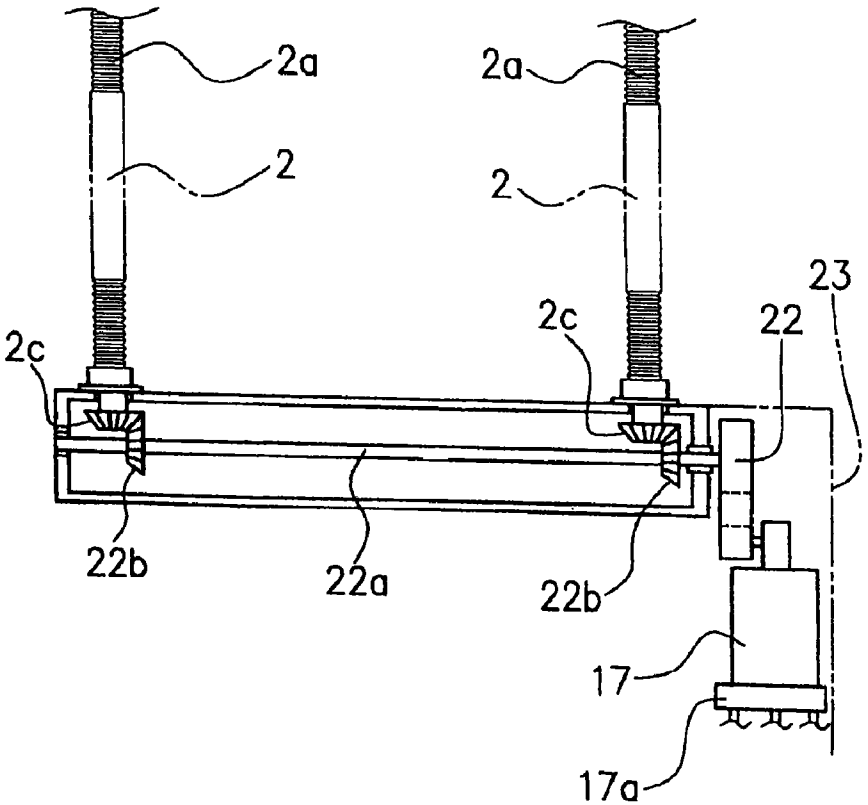
FIGS. 1A-1B show a structure of the tube expander for heat exchanger tubes in the preferred embodiment of the present invention where
Figure 1A:
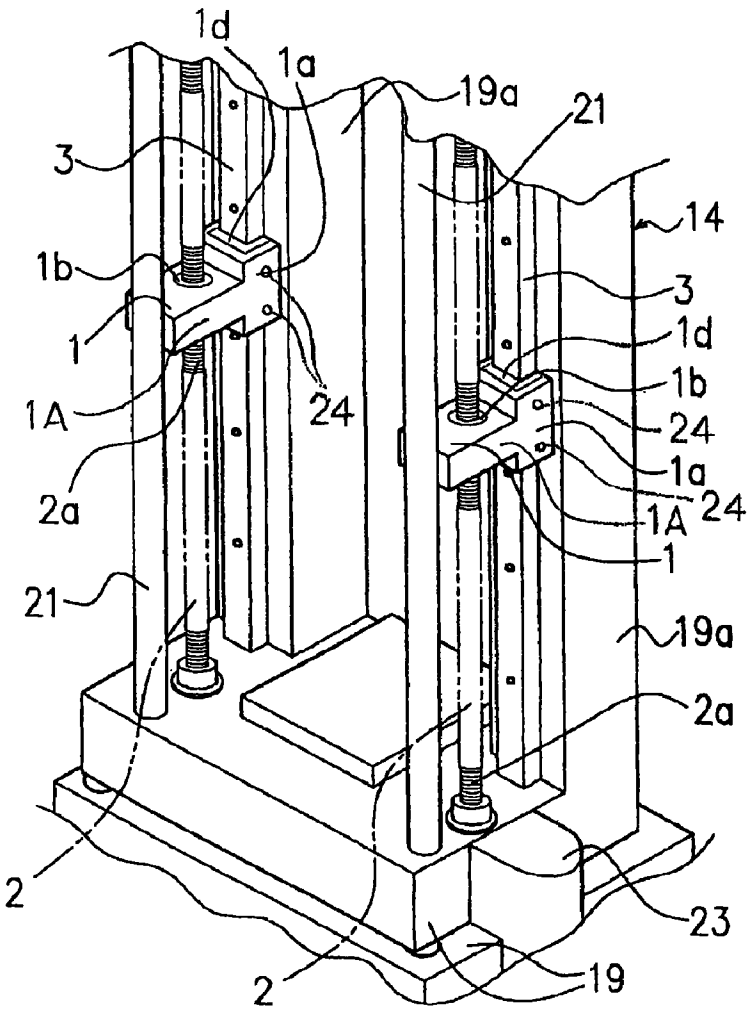

FIGS. 1A-1B illustrate an essential part of the tube expander for heat exchanger tube in the present invention, where a numeral 1 denotes a reference stand. A part of the reference stand that located at a side of a support column 19*a* is provided with a slide unit 1*a* which is slidably attached through a pair of upper and lower bolts (fastening means) 24 over an LM guide (guide bar) 3 formed on each of the support columns 19*a* through a slide body 1*d* which is formed separately from the slide unit 1*a*.

FIGS. 1A-1B illustrate an essential part of the tube expander for heat exchanger tube in the present invention, where a numeral 1 denotes a reference stand, and a numeral 1A denotes a reference stand housing. A part of the reference stand that located at a side of a support column 19*a* is provided with a slide unit 1*a* which is slidably attached through a pair of upper and lower bolts (fastening means) 24 over an LM guide (guide bar) 3 formed on each of the support columns 19*a* through a slide body 1*d* which is formed separately from the reference stand housing 1A.

The slide body 1*d* has a structure that can be freely attached to or detached from the slide unit 1*a* and from the guide bar 3 by either fastening or loosening the bolts (fastening means) 24 as will be described in detail later with reference to FIGS. 5A-5C.

Namely, the slide body 1*d* has a unique structure which enables to be easily removed from the guide bar 3 once it is disconnected from the slide unit 1*a* by loosening the fastening means and slidably shifted either in an upper or lower direction along the guide bar 3. In other words, by loosening the fastening means (bolts 24), the slide body 1*d* mounted around the guide bar 3 is slidably removed (not shown) therefrom either in the upward direction or downward direction along the guide bar 3. Then, the slide body 1*d* is separated from the guide bar 3 as shown in FIG. 5C. Thus, by a process reverse to the above, a new slide body 1*d* for replacement can be attached to the slide unit 1*a* through the fastening means (bolts) 24.

Further, on the reference stand 1, a female screw 1*b* is provided for rotationally inserting therein a rod shaped male screw (guide rod) 2 formed on the base 19 opposite to the support column 19*a*.

At a side end 23 of the base 19, a motor 17 having a pulse encoder 17*a* is installed. In the base 19, gears 22*b* are provided which are attached to a rotary rod 22*a* which is rotated by a belt 22 which is rotated by the motor 17. The gears 22*b* are fitted with gears 22*c* established at the bottom of the rod shaped male screws 2 standing on the base 19.

The tube expander formed in this manner is able to adjust and stop the reference stand 1 at any desired position corresponding to the total length of the heat exchanger (not shown) by the motor 17, pulse encoder 17*a*, and the rotation of the rod shaped male screw 2.

Therefore, when the reference stand 1 momentarily receives the weight of the stripper plate 9, since the part of the reference stand 1 is slidably attached to the LM guide (guide bar) 3 formed on the support column 19*a* through the slide unit 1*a*, the deformation of the rod shaped male screw 2 can be reduced through the slide unit 1*a*. Thus, it is able to avoid brakeage not only at the threads of the rod shaped male screw but also at the contact portion of the reference stand 1 and the female screw 1*b*.

Further, since the female screw 1*b* is provided on the reference stand 1 for rotationally inserting therein the rod shaped male screw (guide rod) 2 formed on the base 19 opposite to the support column 19*a*, even when the total lengths of the heat exchangers for tube expansion are different, it is unnecessary to prepare a cylinder that matches the total length of the heat exchanger and replace the cylinder, because the reference stand 1 can be reciprocally moved in a wide range by the rotation of the rod shaped male screw 2 to an appropriate position that matches the total length of the heat exchanger.

Further, since the slide body 1*d* established separately from the slide unit 1*a* and is removably attached to the slide unit 1*a* through the bolts (fastening means) 24, even in the case where the tube expander of the present invention is established in the poor environment where dusts and dirts are in the air or when the tube expander for heat exchanger tubes is extremely frequently used, only the slide body 1*d* that is worn down can be removed from the slide unit 1*a* through the bolts (fastening means) 24 and a new slide body 1*d* is attached through the bolts 24 easily at low cost, thus, there is no need to replace the reference stand 1 itself.

Figure 2:
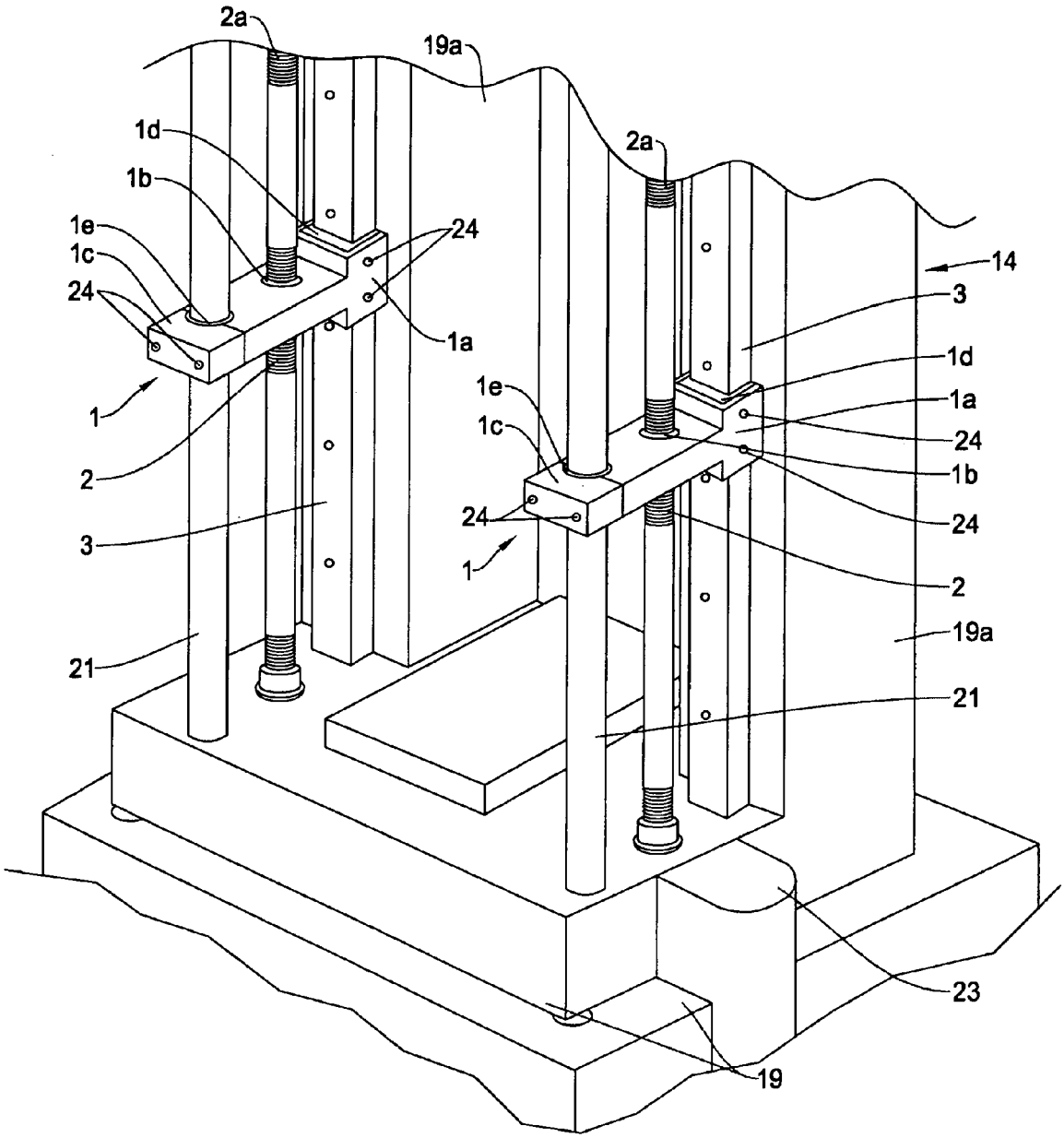
FIG. 2 is a partial perspective view showing a structure of the tube expander for heat exchanger tubes in the preferred embodiment of the present invention in the vicinity of the reference stand.
Figure 3:
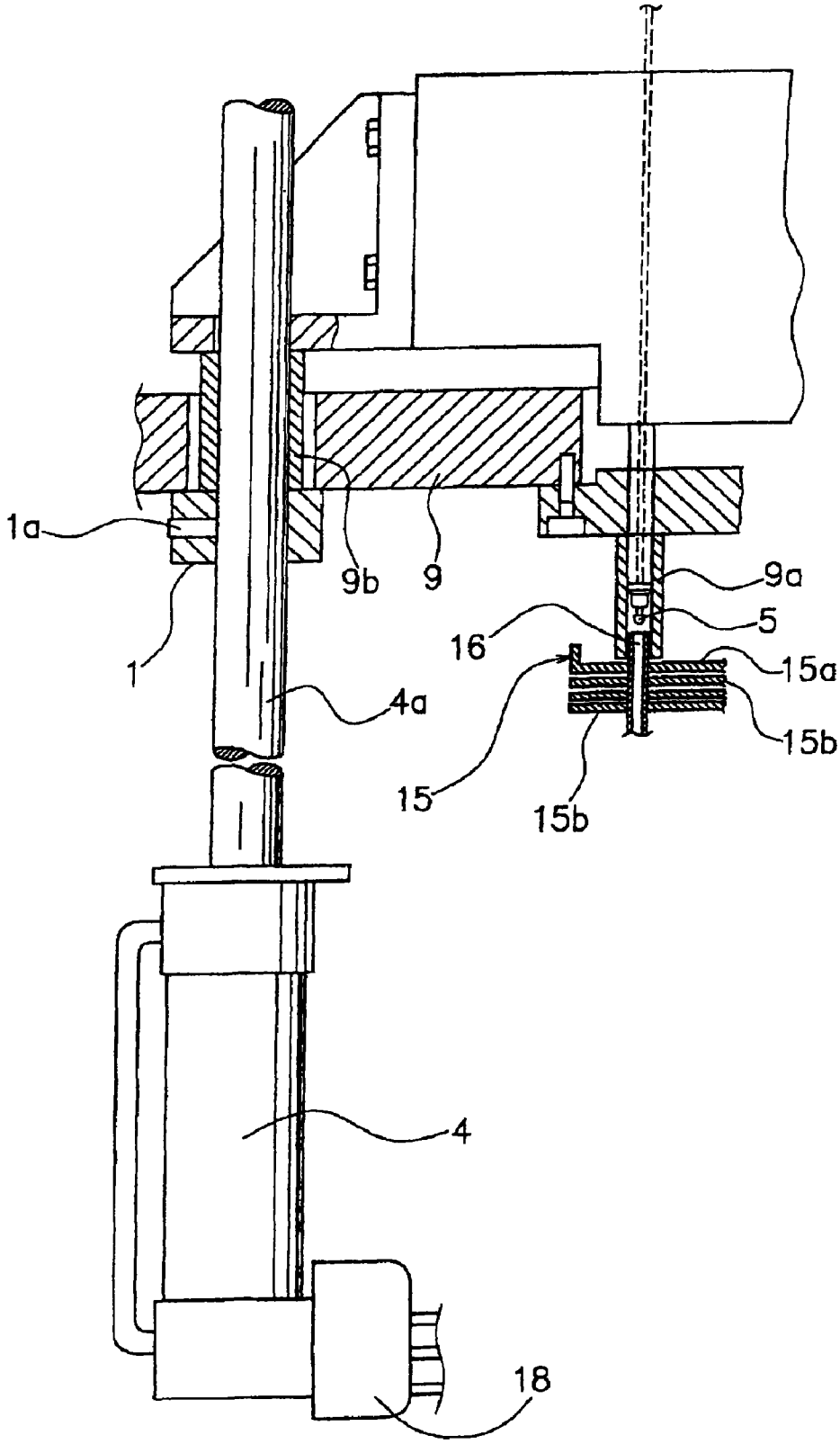
FIG. 3 is a partially enlarged cross sectional view showing an example of structure of the tube expander for heat exchanger in the conventional technology.
Figure 4:
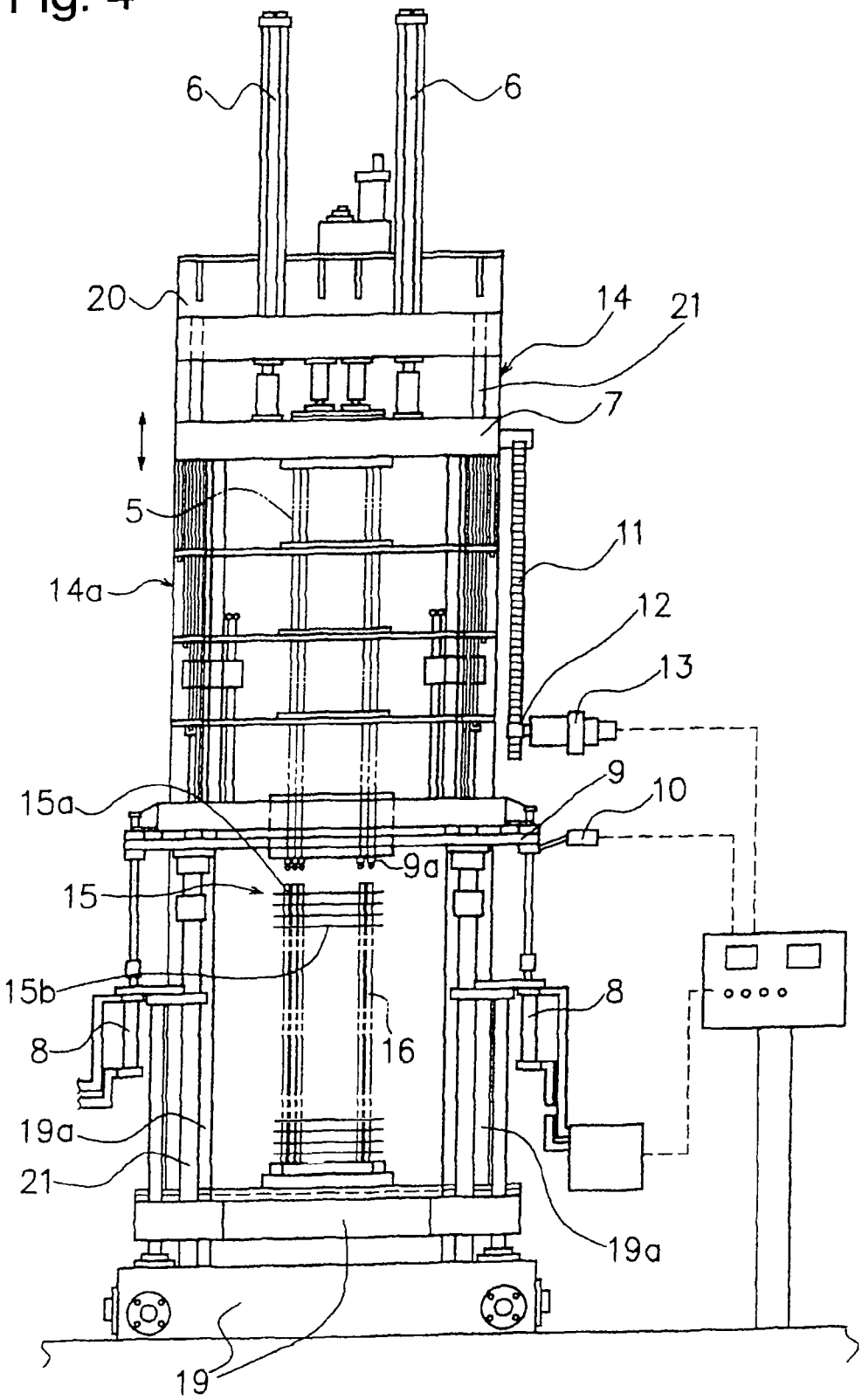
FIG. 4 is a front view showing an example of structure of the tube expander for heat exchanger in the conventional technology.

In FIG. 2, it is also possible that a part of the other side of the reference stand 1 is slidably attached to a guide post (guide bar, slide bar) 21 that is formed opposite to the support column as a reciprocal movement body through a slide unit 1*c*. In other words, in this example, the reference stand 1 is basically configured by the slide unit 1*a* and the slide unit 1*c* connected to one another.

On the slide unit 1*c* located at the guide bar (slide bar) 21 formed opposite to the support column 19*a*, a slide body 1*e* established separately from the slide unit 1*c* is attached thereto. The slide body 1*e* is fitted between the slide unit 1*c* and the slide unit 1*a* and is attached to the slide unit 1*c* through a pair of right/left bolts (fastening means) 24. The slide body 1*e* has a unique structure which enables to be easily removed from the slide bar 21 once it is disconnected from the slide unit 1*c* by loosening the fastening means and slidably shifted either in an upper or lower direction along the slide bar 21 as will be described in more detail later with reference to FIGS. 6A-6C.

Therefore, a part of the reference stand 1 at one side is slidably attached to the guide bar 3 formed on the support column 19*a* through the slide unit 1*a*, and a part of the reference stand 1 at another side is slidably attached to the guide bar established opposite to the support column through the slide unit 1*c*. Namely, the reference stand 1 is supported by both the support column 19*a* and the guide bar 21 in a manner freely moveable. Therefore, even when the reference stand 1 momentarily receives the weight of the stripper plate 9, since the reference stand 1 is supported by a plurality of points, the deformation of the rod shaped male screw can be further reduced by distributing the weight with appropriate balance. Thus, it is able to avoid brakeage not only at the threads of the rod shaped male screw 2 but also at the contact portion of the reference stand 1 and the female screw 1*b*.

Further, since the female screw 1*b* is provided on the reference stand 1 for rotationally inserting therein the rod shaped male screw 2 at a side opposite to the support column 19*a*, even when the total lengths of the heat exchangers for tube expansion are different, it is unnecessary to prepare a cylinder that matches the total length of the heat exchanger and replace the cylinder, because the reference stand 1 can be reciprocally moved in a wide range by the rotation of the rod shaped male screw 2 to an appropriate position that matches the total length of the heat exchanger.

Further, since the slide body 1*e* established separately from the slide unit 1*c* and is removably attached to the slide unit 1*c* through the bolts (fastening means) 24, even in the case where the tube expander of the present invention is established in the poor environment where dusts and dirts are in the air or when the tube expander for heat exchanger tubes is extremely frequently used, only the slide body 1*e* that is worn down can be removed from the slide unit through the fastening means and a new slide body 1*e* is attached through the fastening means easily at low cost, thus, there is no need to replace the reference stand 1 itself.

Further, as noted above, when both of the slide units 1*a* and 1*c* are used, even when the reference stand 1 momentarily receives the weight of the stripper plate 9, since the reference stand 1 is supported by a plurality of points, the deformation of the expansion and contraction rod or the rod shaped male screw can be further reduced by distributing the weight with appropriate balance. It is not necessarily essential for the present invention to use both of the slide units 1*a* and 1*c*. In short, the tube expander for heat exchanger tubes in which a part of the reference stand 1 is attached to the guide bar 3 formed on the support column 19*a* through the slide unit 1*a* can have either a structure in which the slide body 1*d* is detachably provided on the slide unit 1*a* located at the side of the support column 19*a* through the fastening means or a structure wherein a part of the reference stand 1 is slidably attached to the guide bar 21 established opposite to the support column 19*a* through the slide unit 1*c* and the slide body 1*e* is detachably provided on the slide unit 1*c* at the side of the guide bar 21 formed opposite to the support column 19*a* through the fastening means.

An example of specific structure and process for replacing the slide body 1*d* and/or 1*e* will be described in detail here. FIGS. 5A-5C are partial perspective views showing such an example of detailed process and structure for replacing the slide body 1*d* with respect to the guide bar 3 of the tube expander for heat exchanger in accordance with the present invention. FIGS. 6A-6C are partial perspective views showing another of detailed process and structure for replacing the slide body 1*e* with respect to the guide rod 2 of the tube expander for heat exchanger in accordance with the present invention.

Figure 5A:
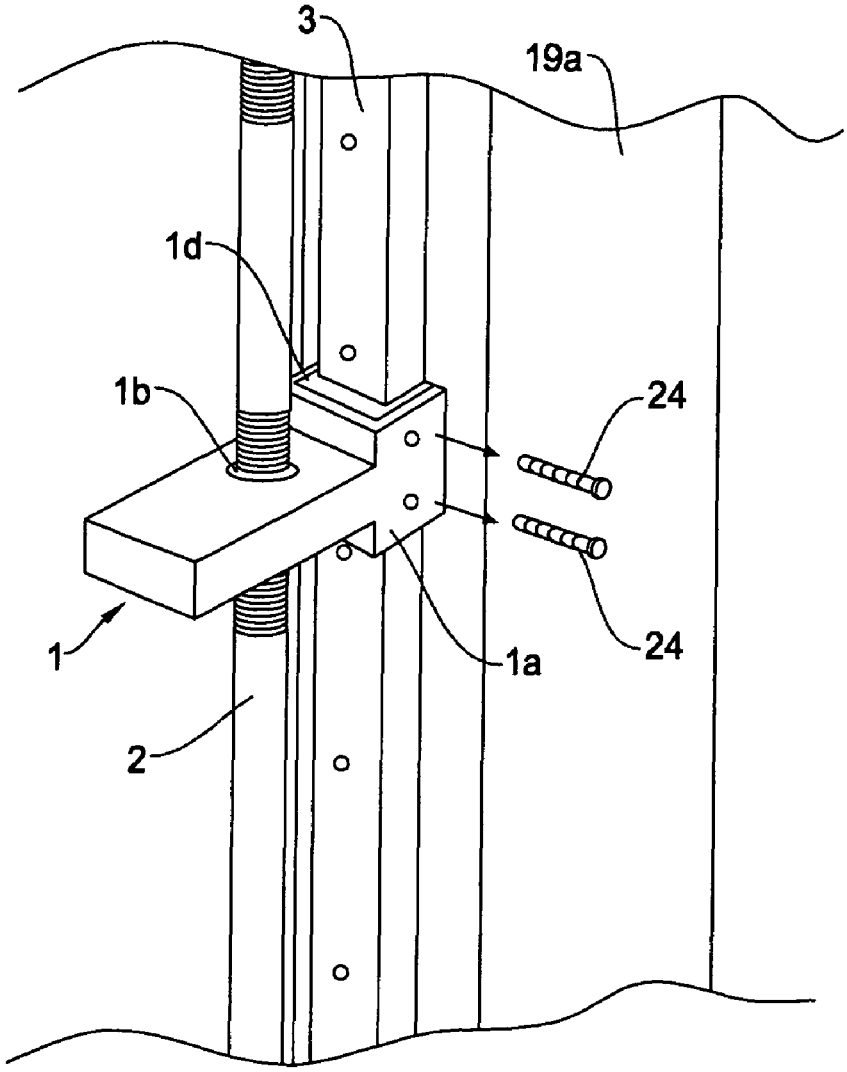
FIGS. 5A-5C are partial perspective views showing an example of detailed process and structure for replacing the slide body with respect to the tube expander for heat exchanger in accordance with the present invention.
Figure 5B:
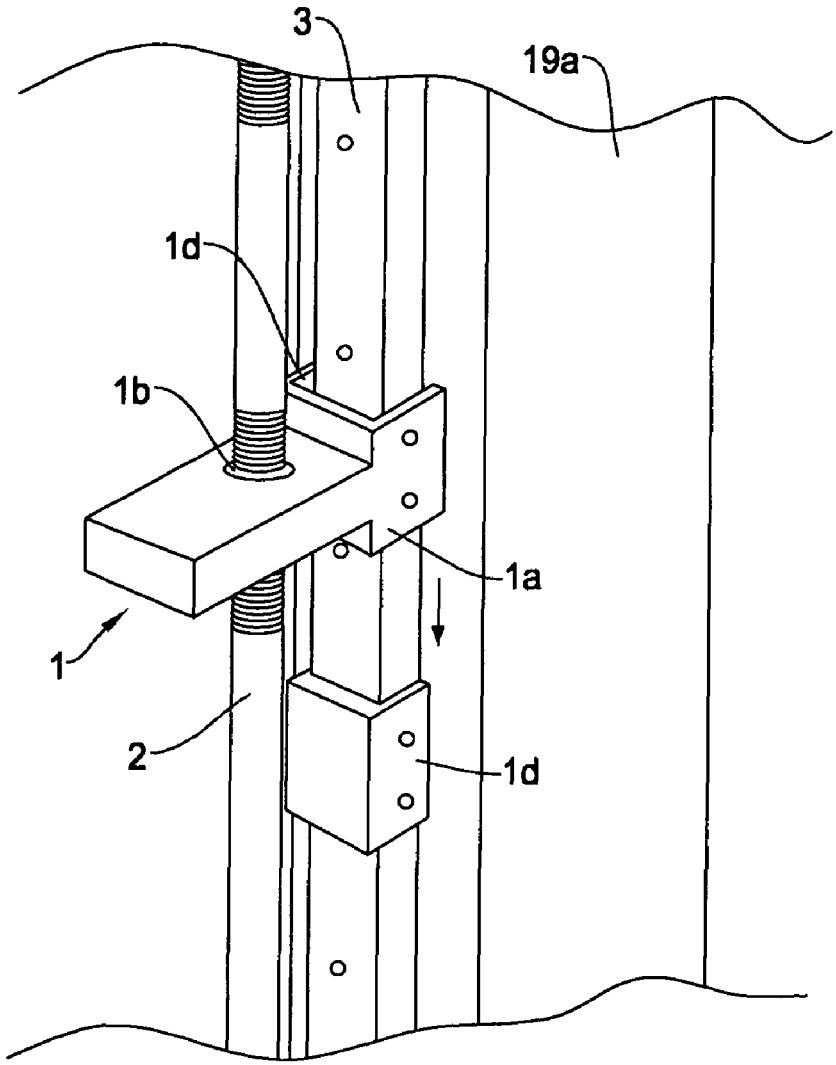
Figure 5C:
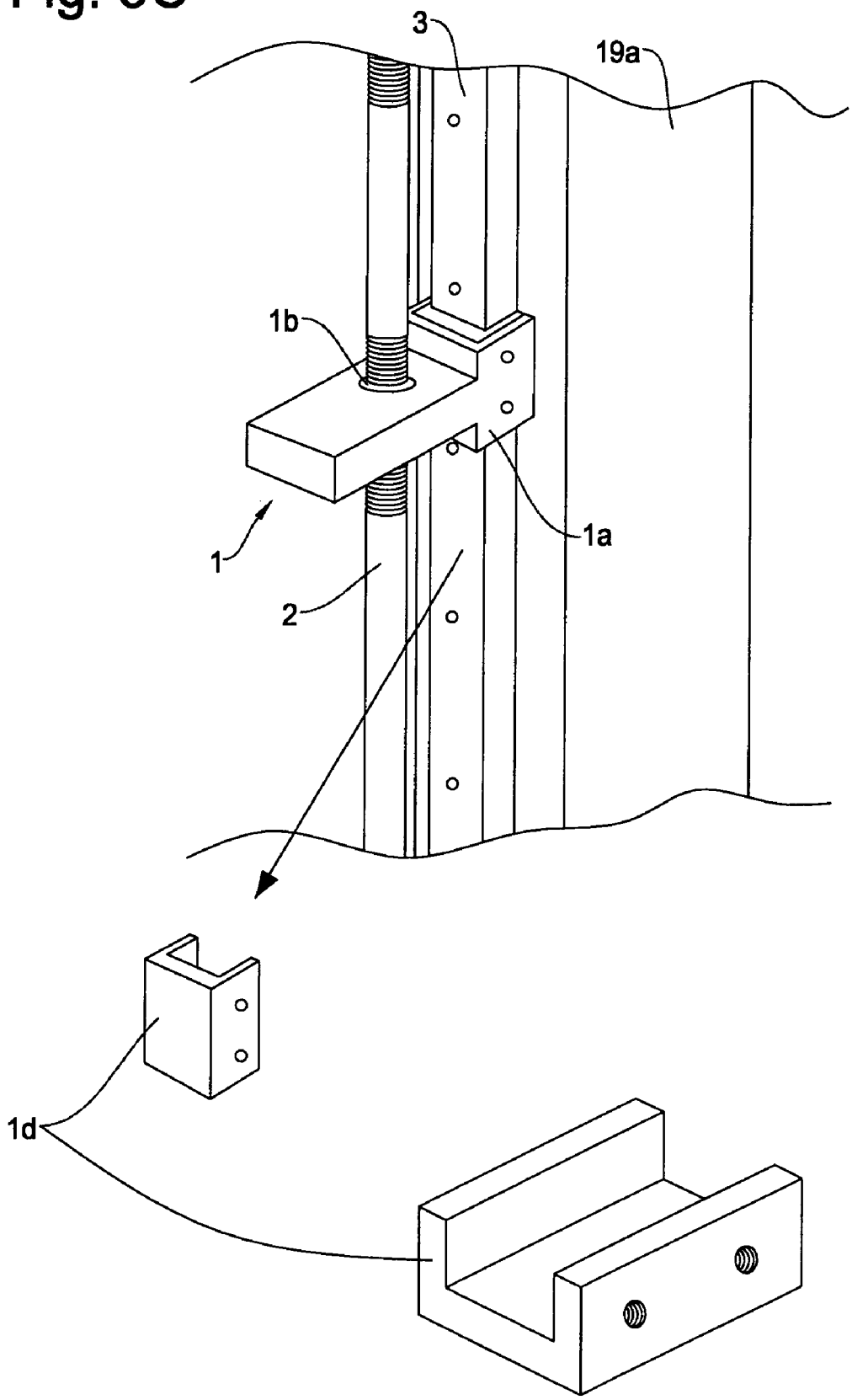
Figure 6A:
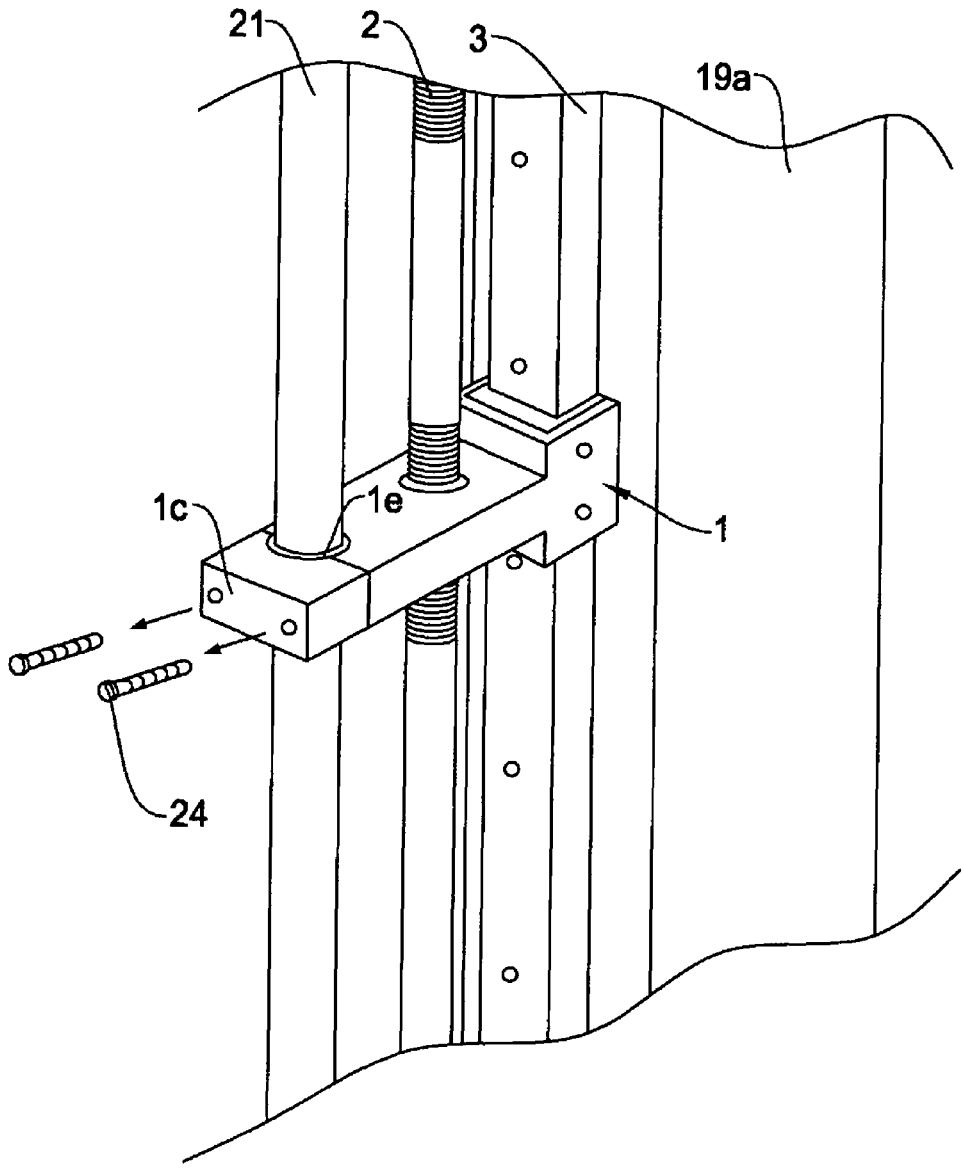
FIGS. 6A-6C are partial perspective views showing another of detailed process and structure for replacing the slide body with respect to the tube expander for heat exchanger in accordance with the present invention.
Figure 6B:
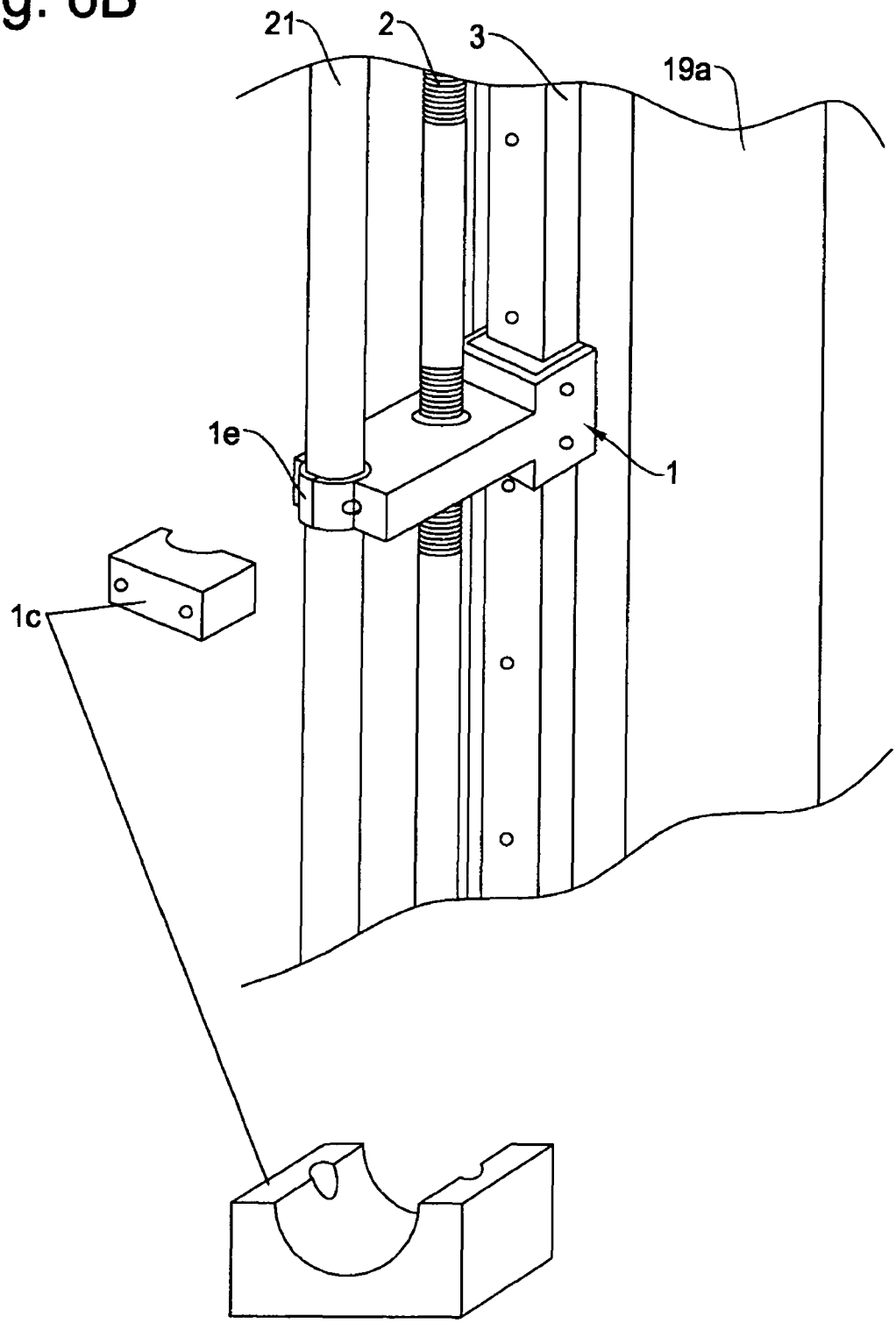
Figure 6C:
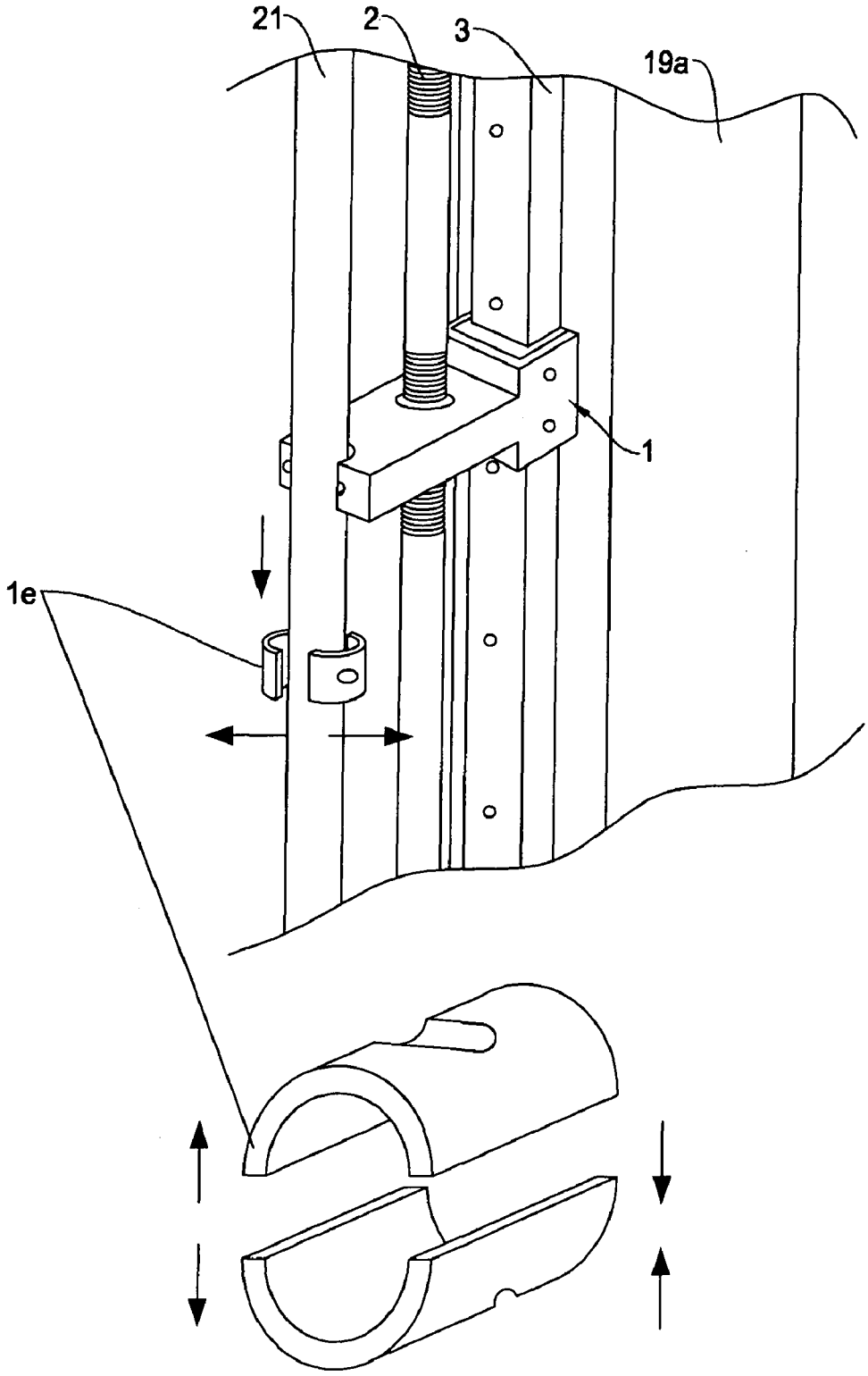

In FIGS. 5A-5C, it should be noted that, the guide bar 21 and slide unit of the reference stand 1, and the slide body 1*e* between the slide bar 21 and the reference stand 1 shown in FIG. 2 are omitted for simplicity of illustration. Further, FIGS. 5A-5C show the process for removing the slide body 1*d* from the slide unit 1*a* and the guide bar 3, it is clear that the process for attaching the slide body 1*d* to the slide unit 1*a* of the reference stand 1 and to the guide bar 3 can be done by reversing the process of FIGS. 5A-5C. As also shown in FIGS. 5A-5C, the slide unit 1*a* and the slide body 1*d* have screw holes (threads) for connecting with one another or disconnecting from one another through the fastening means 24.

In the first step, as shown in FIG. 5A, the slide body 1*d* and the slide unit 1*a* of the reference stand 1 on the guide bar 3 are disconnected from one another by loosening the fastening means (screws) 24. Then, as shown in FIG. 5B, the slide body 1*d* is separated from the slide unit 1*a* by either downwardly or upwardly sliding along the guide bar 3. In this example, since the slide body 1*d* has a U-shape in cross section, i.e., the rear side is open, it can detach from the guide bar 3 as shown in FIG. 5C.

The bottom part of FIG. 5C shows an enlarged view of the slide body 1*d* which is rotated 90 degrees upwardly to more clearly show the structure thereof. Accordingly, the slide body 1*d* can be easily removed from the guide bar 3 and from the slide unit 1*a* of the reference stand 1. The new slide body 1*d* can be attached to the guide bar 3 and the slide unit 1*a* through the process opposite to that described above, i.e., from the steps of FIGS. 5C to 5A.

In the example of FIGS. 6A-6C, the slide body 1*e* has a structure different from that of the slide body 1*d* described above. FIGS. 6A-6C show the process for removing the slide body 1*e* from the slide bar 21, it is clear that the process for attaching the slide body 1*e* to the slide bar 21 can be done by reversing the process of FIGS. 6A-6C. As also shown in FIGS. 6A-6C, the slide unit 1*c* and the slide body 1*e* have screw holes (threads) for connecting with one another or disconnecting from one another through the fastening means 24.

In the first step, as shown in FIG. 6A, the slide body 1*e* and the slide unit 1*c* of the reference stand 1 on the guide bar 3 are disconnected from one another by loosening the fastening means (screws) 24. Then, as shown in FIG. 6B, the slide unit 1*c* is separated from the reference stand 1 and from the slide bar 21. In the next step, the slide body 1*e* is shifted either downwardly or upwardly sliding along the slide bar 21 as shown in FIG. 6C.

In this example, since the slide body 1*e* is structured by a pair of semi-circular bodies, it can detach from the slide bar 21 as shown in FIG. 6C by separating the semi-circular bodies. The bottom part of FIG. 6C shows an enlarged view of the slide body 1*e* which is rotated 90 degrees upwardly to more clearly show the structure thereof. Accordingly, the slide body 1*e* can be easily removed from the slide bar 21 and from the slide unit 1*c* of the reference stand 1. The new slide body 1*e* can be attached to the slide bar 21 and the slide unit 1*c* through the process opposite to that described above.

Therefore, when the reference stand 1 momentarily receives the weight of the stripper plate 9, since the part of the reference stand 1 is slidably attached to the guide bar 3 formed on the support column 19*a* through the slide unit 1*a* or the part of the reference stand 1 is slidably attached to the guide bar 21 formed opposite to the support column 19*a* through the slide unit 1*c*, the 1*c* located at the slide bar 21 opposite to the support column through a fastening means.

In the preferred embodiment described above, the reference stand 1 is movably established on the rotatable rod shaped male screw 2 through the male screw 1*b*. However, it is not necessary to limit to the rod shaped male screw 2 for mounting the reference stand 1. It is also possible that the reference stand 1 is mounted on an extension and contraction rod (not shown) of a cylinder. In such a configuration, in the instant when the reference stand 1 receives the weight of the stripper plate 9, the deformation of the extension and contraction rod can be reduced through the reference stand 1 which is slidably supported at least one of the side or the other side, thereby enabling to avoid the brakeage of the sealing of the cylinder.

Further, the reference stand 1 is mounted on the extension and contraction rod of the cylinder and is slidably attached to the support column 19*a* as noted above, and in the case where a part of the reference stand 1 is movably attached to the guide bar 21 formed opposite to the support column 19*a*, the deformation of the extension and contraction rod is further reduced in the manner described above.

In the preferred embodiment described above, the one side of the reference stand 1 is slidably attached around the LM guide (guide bar) 3 each being formed on the support column 19*a* established on the base 19. However, it is not necessary to limit to the LM guide so long as the reference stand 1 is slidably attached to the guide bar 3 formed on the support column 19*a*.

Further, in the preferred embodiment described above, the tube expander is a vertical type tube expander, however, the present invention can be equally applied to a horizontal type tube expander as well. In short, the tube expander for heat exchanger tubes having in which a part of the reference stand 1 is attached to the guide bar 3 formed on the support column 19*a* through the slide unit 1*a* can have either a structure in which the slide body 1*d* is detachably provided on the slide unit 1*a* located at the side of the support column 19*a* through the fastening means or a structure wherein a part of the reference stand 1 is slidably attached to the guide bar 21 established opposite to the support column 19*a* through the slide unit 1*c* and a slide body 1*e* is detachably provided on the slide unit 1*c* at the side of the guide bar 21 formed opposite to the support column 19*a* through the fastening means. Namely, the present invention is not limited by a shape, structure, mechanism, etc. of each member constituting the tube expander.

Further, in the preferred embodiment described above, the bolts are used for attaching the slide body to the slide unit on the reference stand as the fastening means. However, the present invention is not limited to the use of the bolts but can take other structure where the slide body is attached to the slide unit through such as using various clamp mechanism (not shown) or slit pins (not shown), etc. In short, any means that can attach the slide body formed separately from the reference stand housing to the slide unit on the reference stand. Namely, the present invention is not limited by a shape, structure, mechanism, etc., of a specific member of the fastening means.

In the tube expander of the present invention, the reference stand is provided which is connected to the stripper plate and reciprocally movable along the support column for stopping the stripper plate at a predetermined position, and a part of the reference stand is slidably attached to the guide bar formed on the support column through the slide unit, wherein the slide body formed separately from the reference stand housing is attached to the slide unit located at the side of the support column through the fastening means or a part of the reference stand is slidably attached to the guide bar established opposite to the support column and the slide body established separately from the reference stand housing is provided on the slide unit at the side of the guide bar formed opposite to the support column through the fastening means.

Therefore, when the reference stand momentarily receives the weight of the stripper plate, since either the part of the reference stand is slidably attached to the guide bar formed on the support column through the slide unit or the part of the reference stand slidably attached to the guide bar formed opposite to the support column through the slide unit, the deformation of the expansion and contraction rod or the rod shaped male screw can be reduced through either the slide unit.

Further, in the case where both the slide units corresponding to the guide bar formed on the support column and the slide unit corresponding to the guide bar formed opposite to the support column are used, when the reference stand momentarily receives the weight of the stripper plate, since the reference stand supported by a plurality of points, the deformation of the rod shaped male screw can be securely avoided by distributing the weight of the stripper plate with appropriate balance.

Further, since at least one of the slide body on the slide unit corresponding to the guide bar formed on the support column or the slide body on the slide unit corresponding to the guide bar formed opposite to the support column is detachably provided through the fastening means, in the case where the tube expander of the present invention is established in the poor environment where dusts and dirts are in the air or when the tube expander for heat exchanger tubes is extremely frequently used, only the slide body that is worn down can be removed from the slide unit through the fastening means and a new slide body is attached through the fastening means easily at low cost, thus, there is no need to replace the reference stand itself.

Further, in the tube expander of the present invention, the female screw is provided on the reference stand for receiving the guide rod having the male screw thereon, and the reference stand reciprocally is moved along the support column by the rotation of the guide rod. Therefore, even when the total lengths of the heat exchangers for tube expansion are different, it is unnecessary to prepare a cylinder having an extension and contraction rod of a stroke that matches with the total length of the heat exchanger and replace the cylinder, because the reference stand can be moved in a wide range by the rotation of the guide rod to an appropriate position that matches the total length of the heat exchanger.

As has been described above, in the tube expander of the present invention, the part of the reference stand is slidably attached to the support column or other member through the slide unit. When the tube expander of the present invention is established in the poor environment where dusts and dirts are in the air or when the tube expander for heat exchanger tubes is extremely frequently used, only the slide body that is worn down can be removed from the slide unit means and a new slide body is attached through the fastening means easily at low cost, thus, there is no need to replace the reference stand itself.

What is claimed is:

1. A tube expander for tubes used for a heat exchanger, comprising:

a support column formed on a base;

a stripper plate having strippers which contacts an end plate of the heat exchanger and presses down the end plate for defining a projection length of heat exchanger tubes which are projected from the end plate, the stripper plate being reciprocally movable along a longitudinal direction of the support column; and a reference stand slidably connected to the stripper plate and reciprocally movable along the support column for stopping the stripper plate at a predetermined position;

wherein a part of the reference stand is slidably attached to a guide bar formed on the support column through a slide unit; and wherein a slide body formed between the guide bar and the slide unit located at the support column through a fastening means to slide the reference stand along the guide bar, thereby enabling to quickly replace only the slide body by operating the fastening means and moving away the slide body along the guide bar and separating the slide body from the guide bar without removing the reference stand.

2. A tube expander for tubes used for a heat exchanger, as defined in claim 1, wherein the above noted slide body on the slide unit located at the support column is detachable separately from the slide unit and the reference stand when loosening the fastening means.

3. A tube expander for tubes used for a heat exchanger, as defined in claim 1, further comprising a female screw provided on the reference stand for receiving a guide rod having a male screw thereon, and wherein the reference stand is reciprocally moved along the support column by the rotation of the guide rod.

4. A tube expander for tubes used for a heat exchanger, as defined in claim 2, further comprising a female screw provided on the reference stand for receiving a guide rod having a male screw thereon, and wherein the reference stand is reciprocally moved along the support column by the rotation of the guide rod.

5. A tube expander for tubes used for a heat exchanger, comprising:

a support column formed on a base;

a stripper plate having strippers which contacts an end plate of the heat exchanger and presses down the end plate for defining a projection length of heat exchanger tubes which are projected from the end plate, the stripper plate being reciprocally movable along a longitudinal direction of the support column; and a reference stand slidably connected to the stripper plate and reciprocally movable along the support column for stopping the stripper plate at a predetermined position;

wherein a part of the reference stand is slidably attached to a guide bar formed opposite to the support column through a slide unit; and wherein a slide body formed between the guide bar and the slide unit located at the guide bar opposite to the support column through a fastening means to slide the reference stand along the guide bar, thereby enabling to quickly replace only the slide body by operating the fastening means and moving away the slide body along the guide bar and separating the slide body from the guide bar without removing the reference stand.

6. A tube expander for tubes used for a heat exchanger, as defined in claim 5, wherein the above noted slide body on the slide unit located at the slide bar opposite to the support column is detachable separately from the slide unit and the reference stand when loosening the fastening means.

7. A tube expander for tubes used for a heat exchanger, as defined in claim 5, further comprising a female screw provided on the reference stand for receiving a guide rod having a male screw thereon, and wherein the reference stand is reciprocally moved along the support column by the rotation of the guide rod.

8. A tube expander for tubes used for a heat exchanger, as defined in claim 6, further comprising a female screw provided on the reference stand for receiving a guide rod having a male screw thereon, and wherein the reference stand is reciprocally moved along the support column by the rotation of the guide rod.

* * * * *